US008888097B2

(12) United States Patent
Norrell

(10) Patent No.: US 8,888,097 B2
(45) Date of Patent: Nov. 18, 2014

(54) TABLE GAME WITH SURFACE AND AIR COMPONENTS

(76) Inventor: Robert A. Norrell, Poway, CA (US)

( * ) Notice: Subject to any disclaimer, the term of this patent is extended or adjusted under 35 U.S.C. 154(b) by 322 days.

(21) Appl. No.: 13/612,518

(22) Filed: Sep. 12, 2012

(65) Prior Publication Data

US 2013/0062831 A1 Mar. 14, 2013

Related U.S. Application Data

(60) Provisional application No. 61/534,833, filed on Sep. 14, 2011.

(51) Int. Cl.

| | |
|---|---|
| ***A63B 67/04*** | (2006.01) |
| ***A63F 7/22*** | (2006.01) |
| ***F41J 1/10*** | (2006.01) |
| ***A63F 7/30*** | (2006.01) |
| ***A63F 7/34*** | (2006.01) |

(52) U.S. Cl.

CPC . *A63F 7/305* (2013.01); *A63F 7/34* (2013.01); *A63F 2007/301* (2013.01); *A63F 2007/3015* (2013.01); *A63F 2007/303* (2013.01); *A63F 2007/345* (2013.01); *A63B 67/04* (2013.01)

USPC ..... 273/126 R; 273/407

(58) Field of Classification Search

USPC ..... 273/108.1, 108.5, 118 R, 123 R, 125 A, 273/126 A, 127 B, 126 R, 127 R, 129 R, 317, 273/402–410, 416; 473/416

See application file for complete search history.

(56) References Cited

U.S. PATENT DOCUMENTS

| | | | | | |
|---|---|---|---|---|---|
| 746,993 | A | * | 12/1903 | Boat, Jr. | 273/127 B |
| 2,688,484 | A | * | 9/1954 | Garber | 273/317 |
| 3,228,688 | A | * | 1/1966 | Dennison | 273/108.5 |
| 3,231,277 | A | * | 1/1966 | Holland | 273/352 |
| 3,232,619 | A | * | 2/1966 | Burk | 273/123 R |
| 3,653,666 | A | * | 4/1972 | Barlow et al. | 273/126 R |
| 4,307,882 | A | * | 12/1981 | Hay et al. | 273/317 |
| 4,871,170 | A | * | 10/1989 | Carini | 273/126 R |
| 5,470,057 | A | * | 11/1995 | Bodford, Jr. | 473/416 |
| 8,091,895 | B2 | * | 1/2012 | Allen | 273/407 |

* cited by examiner

*Primary Examiner* — Nini Legesse

(74) *Attorney, Agent, or Firm* — Eric Hanscom; Todd J. Langford

(57) ABSTRACT

This invention is directed toward a table game with, optionally, both an "air game" and a "ground game". This invention relates to the general field of table games, and more specifically to a large table game, similar in size to a ping pong or pool table, playable by one or more people. The theory behind the invention is to combine an "air game" (such as ping pong) with a "ground game" (such as pool) and do so in a flexible format that allows a number of people to participate in the game. The game can be played in an active fashion, similar to Ping-Pong, or as more of a set-up and strategy game, as in pool. A unique paddle-shaped hitting device with a hockey-stick like projection on its bottom portion allows for a player to play both the air game and the ground game using the same hitting device.

20 Claims, 5 Drawing Sheets

TABLE GAME WITH SURFACE AND AIR COMPONENTS

CROSS REFERENCE TO RELATED APPLICATIONS

This application claims the benefit of U.S. Provisional Patent Application No. 61/534,833 filed on Sep. 14, 2011, the entirety of which is hereby incorporated by reference.

STATEMENT REGARDING FEDERALLY SPONSORED RESEARCH OR DEVELOPMENT

This invention was not federally sponsored.

BACKGROUND OF THE INVENTION

Field of the Invention

This invention relates to the general field of table games, and more specifically to a large table game, similar in size to a Ping-Pong or pool table, playable by one or more people. The theory behind the invention is to combine an "air game" (such as Ping-Pong) with a "ground game" (such as pool) and do so in a flexible format that allows a number of people to participate in the game. The game can be played in an active fashion, similar to Ping-Pong, or as more of a set-up and strategy game, as in pool. A unique paddle-shaped hitting device with a hockey-stick like projection on its bottom portion allows for a player to play both the air game and the ground game using the same hitting device. It is also anticipated that the game could be played without a paddle; only with the use of a player's hands.

History of the invention's industry. Games have been an integral part of human entertainment for centuries. While games appear to have begun along the lines of card games and board games, larger table games began to appear in recorded history during the 1600's when billiards was described in printed literature.

As table games evolved, they split into two general types of games. First, there were the strategy games, in which players planned their moves, and then tried to execute an action. Pool is a good example of this type of strategy game. There is no rush for pool players; they have plenty of time to line up and take their shots. The second direction games took were fast-paced games where a player's quick reactions were often what decided the outcome of a game. Ping-Pong, foosball and air hockey are all examples of fast-paced, reactionary games.

While each of these games is desirable to a certain group of users, there is little carryover from one group to the other. For example, the owner of a pool table is unable to effectively "speed up" the game of pool, such that the players get good exercise, unless he or she is willing to risk ruining the felt surface due to a hurried and inaccurate "strike". At the same time, it would be very difficult to slow down ping pong or air hockey such that the players had adequate time to intelligently plan their next moves.

Thus, the lack of cross over between the two genres of table games has created a problematic situation where someone who wants both a strategic and a reactionary table game has to buy one of each. The generally large size of such table games makes the purchase of two table games undesirable as rare is the house that is large enough to accommodate two table games. There are folding table games, such as ping pong, but generally these folding versions tend to warp and are inferior to a fixed table game.

Thus there has existed a long-felt need for a table game that can have both strategic and reactionary components.

SUMMARY OF THE INVENTION

The current invention provides just such a solution by having a table game, similar in size to a Ping-Pong or pool table, with both an "air game" and a "ground game". Optionally, either the air game or the ground game can be removed such that either version can be played independently. The table game is constructed both in terms of physical characteristics and rules to create a flexible format that allows a number of people to participate in the game, and also provides two possible game formats: the game can be played in an active fashion, similar to ping pong, or as more of a set-up and strategy game, as in pool. Thus, the flexibility of the game allows for it to serve as both entertainment and, if desired, physical exercise, for a number of people. While the game can be played with only hands, one embodiment of the invention calls for a unique paddle-shaped hitting device with a hockey-stick like projection on its bottom portion allows for a player to play both the air game and the ground game using the same hitting device.

It is a principal object of the invention to provide a game with both an air game and a ground game.

It is another object of the invention to provide a game that can be played by between one and eight players.

A further object of the invention is to provide a game that can be played with hands or a paddle.

Another object of the invention is to provide a game that allows for a wide range of handicapping options.

It is a further object of the invention to provide a game that can be played as a slow-paced strategy game, or as a fast-paced reactionary game.

A further object of the game allows for skilled players to become "position specialists" where they concentrate on offense or defense, or are brought in to perform a particular offensive or defensive function at which they are unusually skilled.

Another object of the game is to allow handicapping in a variety of creative manners, to allow skilled and unskilled players to compete with each other. Among the means of affecting handicapping are: increasing or decreasing the size of the shooting channels, traps, and goal holes, increasing or decreasing the size of the openings in the air game, and allowing for increased points for a player who strikes the ball and/or defends from a greater distance behind the table.

A particular embodiment of the current invention is a table game comprising a ground game board, an air game board, four adjustable legs, optionally, a paddle or, optionally, just the hands of a player, an adjustable return panel, and a ball, where the ground game board comprises a plurality of goal holes and a plurality of traps, where each goal hole and trap comprises an opening, where at least one of the plurality of goal holes further comprises an insert, where the insert of the goal hole comprises a hole that is smaller than the size of the goal hole, whereby the insert of the goal hole may be inserted into the goal hole to decrease the size of the opening of the goal hole thereby making it more difficult to pass the ball through the goal hole, where at least one of the plurality of traps further comprises an insert, where the insert of the trap comprises a hole that is smaller than the size of the trap, whereby the insert of the trap may be inserted into the trap to decrease the size of the opening of the trap thereby making it more difficult to pass the ball through the trap, where some traps located to the sides of the table can be used to widen the shooting channels by the addition of an insert, where the air game board comprises two goal posts, a horizontal cross-bar, and a vertical cross-bar, where the air game board is attached to the ground game board, and where the ground game board is located in a horizontal orientation, where the air game board is located in a vertical orientation, where the ball may be directed through the one or more goal holes or traps, where there are one or more end traps into which the ball can roll if it does not reach a goal, where the return board comprises two flat surfaces, where the two flat surfaces of the return board are joined at a pivot point, where the angle of each of the two flat surfaces of the return board is adjustable such that each flat surface of the return board is parallel to the other or angled, whereby an angled flat surface of the return board causes a ball placed thereon to move towards one side of the table game, where the paddle comprises a handle portion and may be used to strike the ball.

Another embodiment of the current invention is a table game comprising a ground game board, an air game board, four legs, an adjustable return panel, and a ball, where the ground game board comprises a plurality of goal holes and a plurality of traps, where each goal hole and trap comprises an opening, where the air game board comprises two goal posts and a horizontal cross bar, where the air game board is attached to the ground game board, and where the ground game board is located in a horizontal orientation, where the air game board is located in a vertical orientation, where the ball may be directed through the one or more goal holes or traps, where the return board comprises two flat surfaces, where the two flat surfaces of the return board are joined at a pivot point, where the angle of each of the two flat surfaces of the return board is adjustable such that each flat surface of the return board is parallel to the other or angled, whereby an angled flat surface of the return board causes a ball placed thereon to move towards one side of the table game.

An additional embodiment of the current invention is a method of playing a table game comprising the steps of obtaining a game table, where the game table comprises a ground game board, an air game board, four legs, an adjustable return panel, and a ball, where the ground game board comprises a plurality of goal holes and a plurality of traps, where each goal hole and trap comprises an opening, where the air game board comprises two goal posts and a horizontal cross bar, where the air game board is attached to the ground game board, and where the ground game board is located in a horizontal orientation, where the air game board is located in a vertical orientation, where the ball may be directed through the one or more goal holes or traps, where the return board comprises two flat surfaces, where the two flat surfaces of the return board are joined at a pivot point, where the angle of each of the two flat surfaces of the return board is adjustable such that each flat surface of the return board is parallel to the other or angled, whereby an angled flat surface of the return board causes a ball placed thereon to move towards one side of the table game, and shooting the ball into one of the plurality of goal holes.

In yet another embodiment, the current invention is a method of playing a table game comprising the steps of obtaining a game table, where the game table comprises a ground game board, an air game board, four legs, an adjustable return panel, a ball, and a second ball, where the ground game board comprises a plurality of goal holes and a plurality of traps, where each goal hole and trap comprises an opening, where the air game board comprises two goal posts and a horizontal cross bar, where the air game board is attached to the ground game board, and where the ground game board is located in a horizontal orientation, where the air game board is located in a vertical orientation, where the ball may be directed through the one or more goal holes or traps, where the return board comprises two flat surfaces, where the two flat surfaces of the return board are joined at a pivot point, where the angle of each of the two flat surfaces of the return board is adjustable such that each flat surface of the return board is parallel to the other or angled, whereby an angled flat surface of the return board causes a ball placed thereon to move towards one side of the table game, shooting the ball into one of the plurality of goal holes, and a second player shooting the second ball at the same time that the first ball is shot, whereby two players play on the same game table simultaneously.

In yet another embodiment of the game, it is contemplated that different players could be assigned "offensive" or "defensive" tasks, or even "set-up" tasks, such as in volleyball, where a "setter" is given the task of preparing the ball for a "striker" to slam down onto the other side of the net. By allowing for people to specialize in certain tasks, it is contemplated that if professional tournaments are held using this invention, that specialized players could develop to handle only certain aspects of the game.

Another embodiment of the game allows for the use of mats of varying tackiness to be placed on various parts of the board to retard the speed of the ball or other object being used to score goals. It is further contemplated that these mats could be used to handicap a game, with mats of greater tackiness given to the less experienced player to allow him/her more time to react in a defensive mode to an opponent's shot.

It is further contemplated that the game could be used for entertainment purposes by the physically challenged, with mechanical devices used to position and strike the ball, and with other mechanical devices used to defend one's goals. Joysticks or video game controllers could be used to control the mechanical devices, or in the case of a severely challenged individual, voice-activated controls could be used.

It is also contemplated the game can be played with a player's hands, or with a paddle, and that the size and shape of the paddle, or even allowing a player access to a paddle, may be used to handicap the game.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims.

BRIEF DESCRIPTION OF THE FIGURES

The accompanying drawings, which are incorporated in and form a part of this specification, illustrate embodiments of the invention and together with the description, serve to explain the principles of this invention.

DETAILED DESCRIPTION OF THE INVENTION

Figures 1, 2:
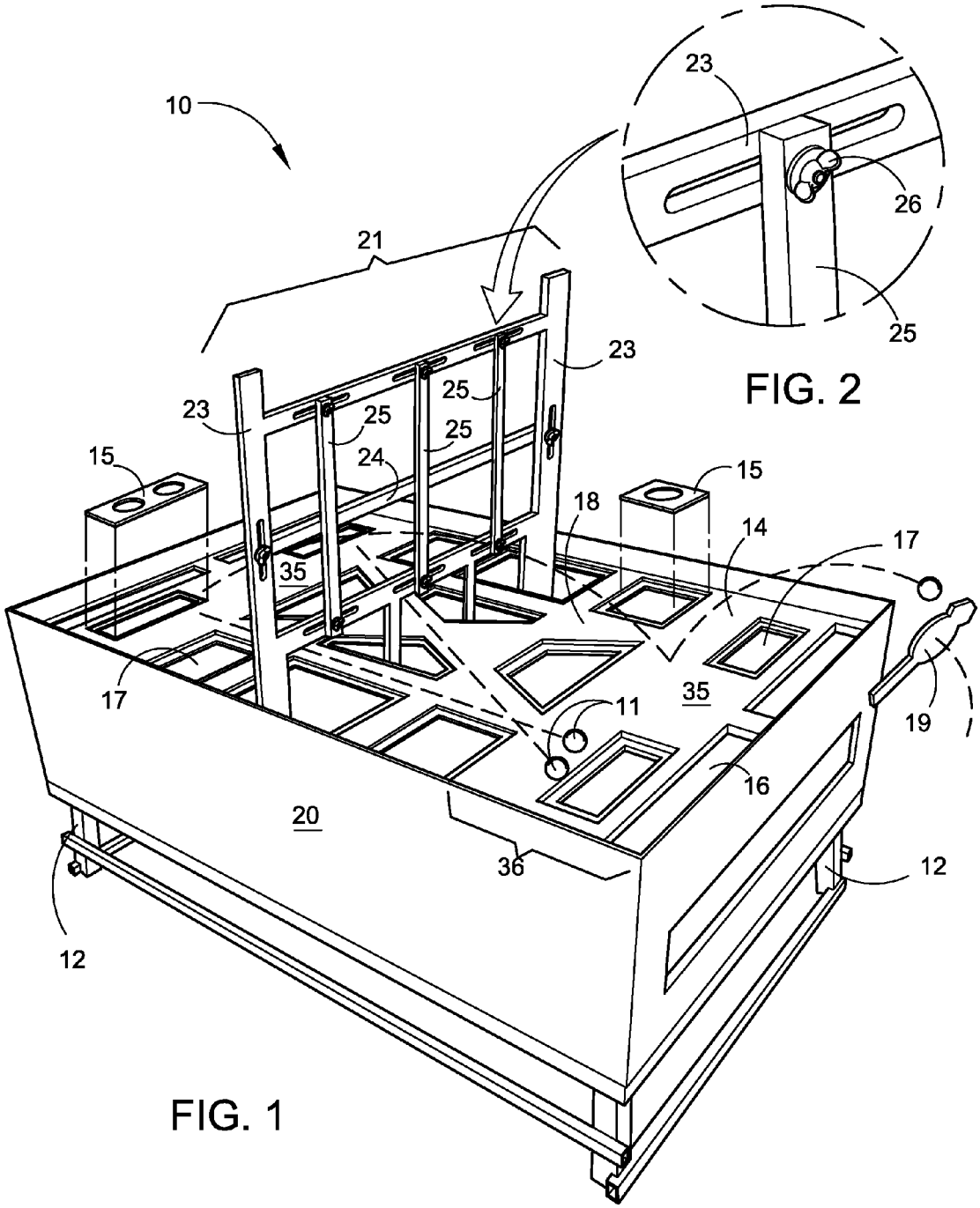
FIG. 1 is a perspective view of a table game according to selected embodiments of the current disclosure.
FIG. 2 is a close-up perspective view of a connection between the vertical cross member and the air game board of a table game according to selected embodiments of the current disclosure.

Many aspects of the invention can be better understood with the references made to the drawings below. The components in the drawings are not necessarily drawn to scale. Instead, emphasis is placed upon clearly illustrating the components of the present invention. Moreover, like reference numerals designate corresponding parts through the several views in the drawings.

FIG. 1 is a perspective view of a table game according to selected embodiments of the current disclosure. The general game 10 comprises four adjustable legs 12 that support a ground game board 14 and an air game board 21. Underneath the ground game board is an adjustable return panel with pivot point (not shown in this figure), which serves to return balls or other objects to one side or the other. The adjustable pivot point allows players to change the direction of the return so that they can play with themselves without requiring a second player to participate. There is also an optional paddle 19, that can be used to strike the ball.

The ground game board has two staging areas 35, one on each side. The staging area is where players on offense plan their attack, and where players on defense try to defend. There is also a starting region 36, where in some versions of the game, a player begins moving the ball from this region. The general idea of scoring is to take a ball, where the term "ball" refers to a ball, puck, or other movable device, and shoot it from your staging area, across the shooting channels 18, avoiding the traps/inserts 15, avoiding any defensive measures the other side puts forth, such that your ball ends up in one of the other side's goal holes 17. The traps/inserts 15 comprise a hole of varying shape in the ground game board 14, into which an insert of varying size can be placed to make it more or less likely that a ball will fall into the trap and be removed from play. This is a means by which the game can be handicapped to allow players of different skill levels to compete. For example, in a situation where a novice player competes with an expert, the novice could have no inserts whatsoever, such that it would be more difficult for the skilled player to get his/her ball past the traps, while very large inserts could be placed in the skilled player's holes such that it was very unlikely that the novice's shots would end up in the hole. One or more return traps 16 can trap a ball that has passed by a goal hole, and the return trap could also have inserts if desired. It is also possible to handicap the game by awarding more points to a player who stands further from the table, or by making the more experienced player stand a certain distance back from the table.

The goal holes 17 and traps/inserts 15 can have inserts, which are sections that can be inserted into the goal holes 17 and traps/inserts 15 that decrease the size of the goal hole 17 and traps/inserts 15, thereby making it more difficult (in the case of inserts in the goal holes) or easier (in the case of inserts in the traps) to score. It is envisioned that one way to allow players of different skill levels against each other in a competitive manner would be to handicap the weaker player by decreasing the size of his goal holes and decreasing the size of the traps through adding inserts. Sidewalls 20 help restrain the balls within the game, such that played balls are more likely to stay on or above the ground game board 14.

The traps/inserts 15 are sections of the ground game board 14 that have been cut out. The inserts are the sections that are removable from the ground game board 14; the traps are the cavities that are left once the trap panels are removed (or decreased in size because of the insert). The removal of the trap panels creates the traps (or larger traps), which define the shooting channels 18. The shooting channels 18 are what are left of the ground game board 14; the areas of the middle of the ground game board that are not open. It is envisioned that the sections cut out from the traps (inserts) can be re-inserted as a way of modifying the game. It is also envisioned that adding inserts to one side of the ground game board 14 and removing inserts from the other side of the ground game board 14 is a way to handicap an experienced player by giving him smaller shooting channels 18 and aiding a weaker player by giving him larger shooting channels 18.

The air game comprises an air game board 21 that includes vertical goal posts 23 of wood, Plexiglas, plastic, or another clear or opaque material, raised approximately two inches over the surface of the ground game board 14. The air game board 21 is approximately eighteen inches in height in a preferred embodiment, with the goal posts made from Plexiglas or another clear material. However, it must be appreciated by those skilled in the art that other heights may be implemented, such as an air game board that extends twenty-four inches above the ground game board. Vertical cross-bars 25 and horizontal cross-bars 24 may be affixed to the air game board 21 by wing nuts 26. These cross-bars create obstructions that limit the ability of a player to hit a ball into his opponent's goal holes 17. Goalposts 23 set the right and left limits of the area through which you can shoot your ball onto the other side's territory. The ball has to be hit to either under (such as on the ground game board 14, or "ground game"), through, or over the air game board 21 and between the goalposts 23 to score a goal into one of the other side's goal holes 17 ("air game").

The game allows for a player on offense to try to score into the other side's goal holes through either the ground game or air game. For a slow-paced, strategic version of the game, there is only one ball in play at any particular time, and the defensive player is limited in terms of how he can defend his goal holes. For example, one version of the game allows a defensive player to defend his goal holes only through striking a defensive ball laterally across the table to strike the offensive ball before it reaches a goal hole. Players can either take turns on offense, such as when each player gets to shoot balls 11 during his offensive turn, or one player can remain playing offense until he either scores or the defensive player stops the ball on the defensive player's side of the table, similar to cricket or baseball. Players can also be limited to a certain amount of time by a clock, such that, for example, each offensive "turn" lasts two minutes before the offensive and defensive players reverse roles. Alternatively, an offensive player can be given a certain number of "strokes" to get his ball positioned and shot into the defender's goal, sort of like a version of golf. The balls 11 and path lines emanating therefrom in FIG. 1 show a sequence where the offensive player is allowed three shots to score a goal. It is also contemplated that the game can be handicapped by forcing a more experienced player to begin his/her turn a certain distance back from the table, or to play with larger or smaller goal holes, traps, and wider or narrower shooting channels.

For a fast-paced, reactionary game, more than one ball is put in play at any one time, putting a player's reactions at a premium. Rules can allow for one player to "hog" the balls so that he can shoot several at one time or in a rapid sequence, thereby making it more difficult for the defensive player to block the shots.

The game can be played effectively by anywhere from one to eight people at a single time. In theory, more than eight players could play the game simultaneously, but eight players is the maximum number in a particular embodiment of the invention.

For a solo player, he begins by turning the pivot point of the return panel "up" on the other side of the ground game table (discussed in more detail below), such that any balls he loses into either the traps or the goal holes on the other side of the table are returned to him. In this manner, he can practice his offensive skills in both the ground game and air game.

For two players, in one embodiment of the game, where the players take turns on offense and defense, the offensive player takes an offensive position and tries to get one or more game balls 11 into the goal holes 16 of the defensive player. The defensive player takes a defensive position and tries to deflect the offensive player's game balls before they reach the goal holes. In this embodiment, after either a set number of balls (strategic version) or a set amount of time with unlimited balls (reactionary version), the offensive player goes on defense and the defensive player goes on offense. A paddle 19 may be used by the defensive player to block the shots of the offensive player. As shown in this figure, paddle 19 includes a handle portion that may be grasped by a player. Alternatively, the game can be played without paddles, or access to a paddle can be used to handicap the game by allowing only the less skilled player to use a paddle.

For four players, one embodiment of the game calls for one or more balls to be in play at any one time, and on each team, one player plays offense in the offensive position and his/her teammate plays defense in the defensive position.

For eight players, offensively the players line up very similarly to doubles in tennis or Ping-Pong, with one offensive player on either side of the offensive zone. Each team also has two defensive players, one of whom sets up on either side of the table in the doubles defensive positions.

FIG. 2 is a close-up perspective view of a connection between the vertical cross member and the air game board of a table game according to selected embodiments of the current disclosure. A vertical cross-bar 25 is secured to the air game board 21 by means of a wing nut 26. As will be appreciated by those skilled in the art, other means of securing cross-bars to the air game board are possible, including regular nuts and bolts, hook and loop fasteners, and magnets.

Figure 3:
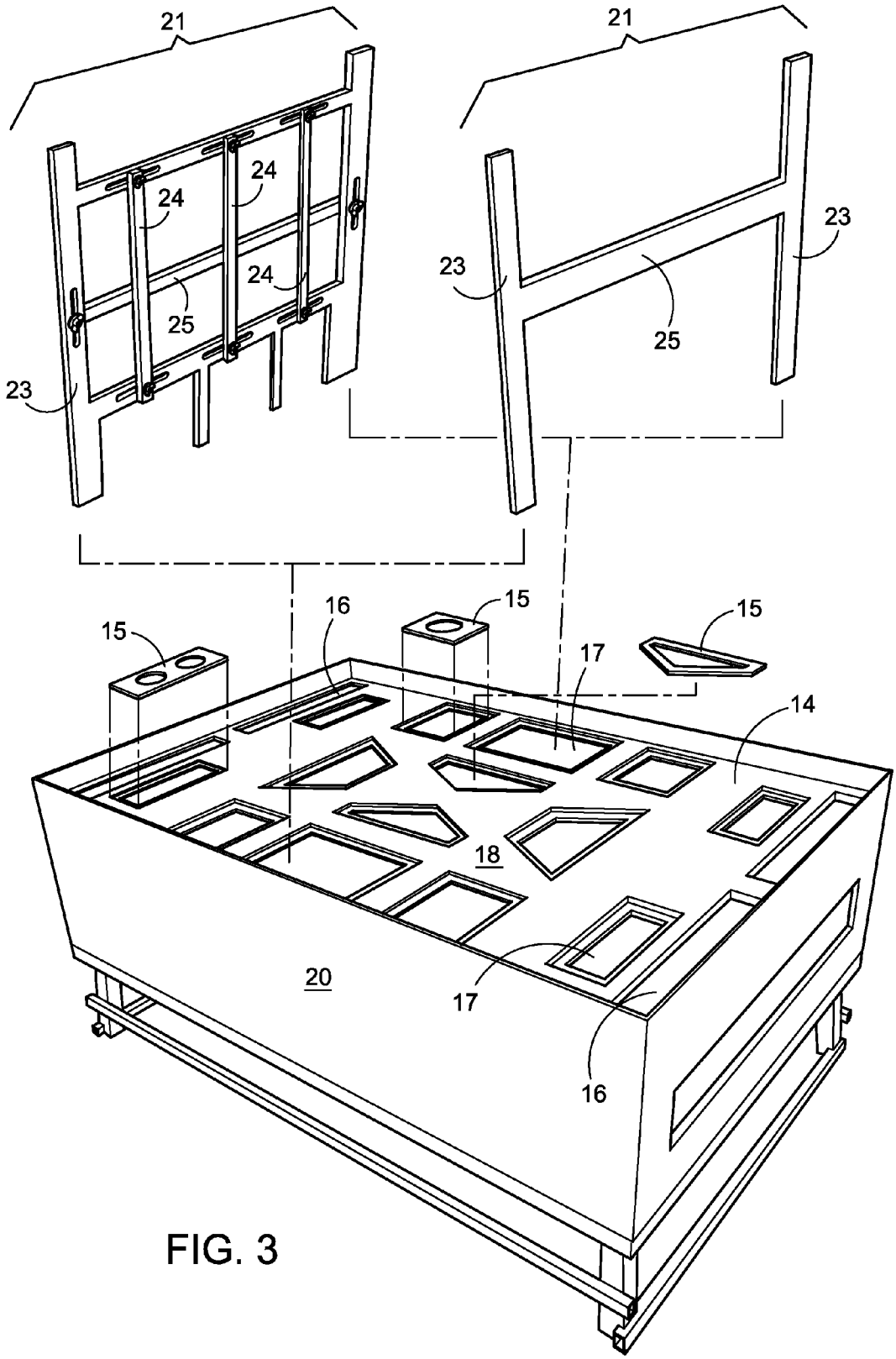
FIG. 3 is an exploded perspective view of a table game according to selected embodiments of the current disclosure.

FIG. 3 is an exploded perspective view of a table game according to selected embodiments of the current disclosure. Two different air game boards 21 are shown, though it is contemplated that only one air game board be used with the game at any one time. One air game board 21 is similar to that shown in FIG. 1, while the other air game board 21 is a simplified version, wherein it has two goal posts 23 and a single vertical cross-bar 25 permanently affixed thereto. FIG. 3 also shows traps 17 of different shapes and sizes as well as inserts 15 that secure thereto. The inserts 15 may have openings located therein that are the same or different shape as that of the outside of the insert.

Figure 4:
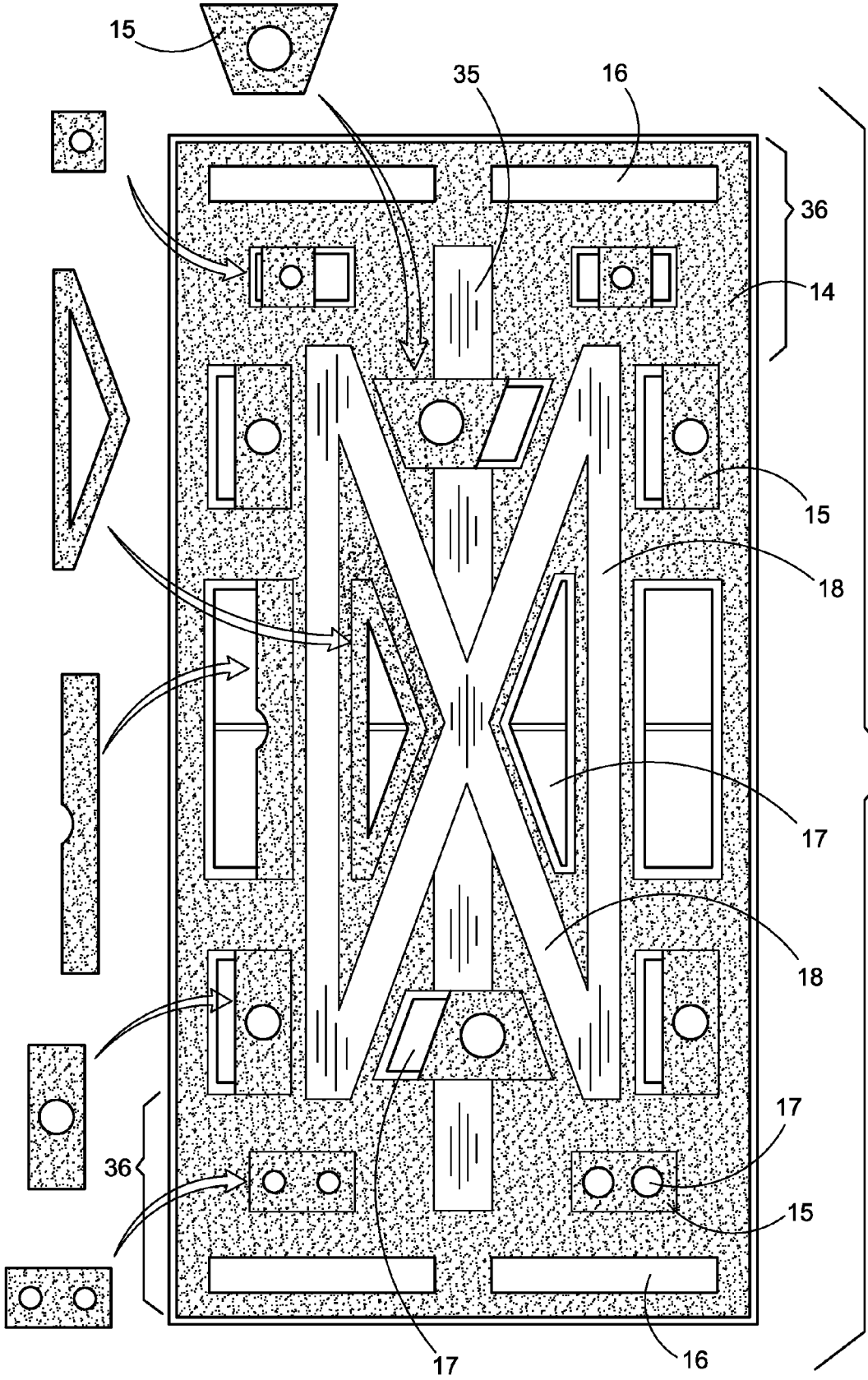
FIG. 4 is a top view of a table game according to selected embodiments of the current disclosure.

FIG. 4 is a top view of a table game according to selected embodiments of the current disclosure. Inserts 15 of different shapes and sizes are shown separated from and inserted into traps 17. The inserts may cover the entire trap or leave a portion exposed. For example, the insert 15 may have one or more holes on the inside of the insert. Alternatively, the outside of the insert 15 may be smaller than the trap 17, whereby the insert 15 may slide from side to side within the trap 17. In yet another alternative, the insert 15 may be smaller than the trap 17 as well as have a hole incorporated therein. In any event, shooting channels 18 should remain available for players to shoot a ball over in an attempt to get the ball into a goal hole 16. As mentioned previously, the width of the shooting channels can be adjusted by placing inserts into the traps on either side of the shooting channels. The ground game board 14 has two staging areas 35, one on each side. The staging area is where players on offense plan their attack, and where players on defense try to defend. There is also a starting region 36, where in some versions of the game, a player begins moving the ball from this region.

Figure 5:
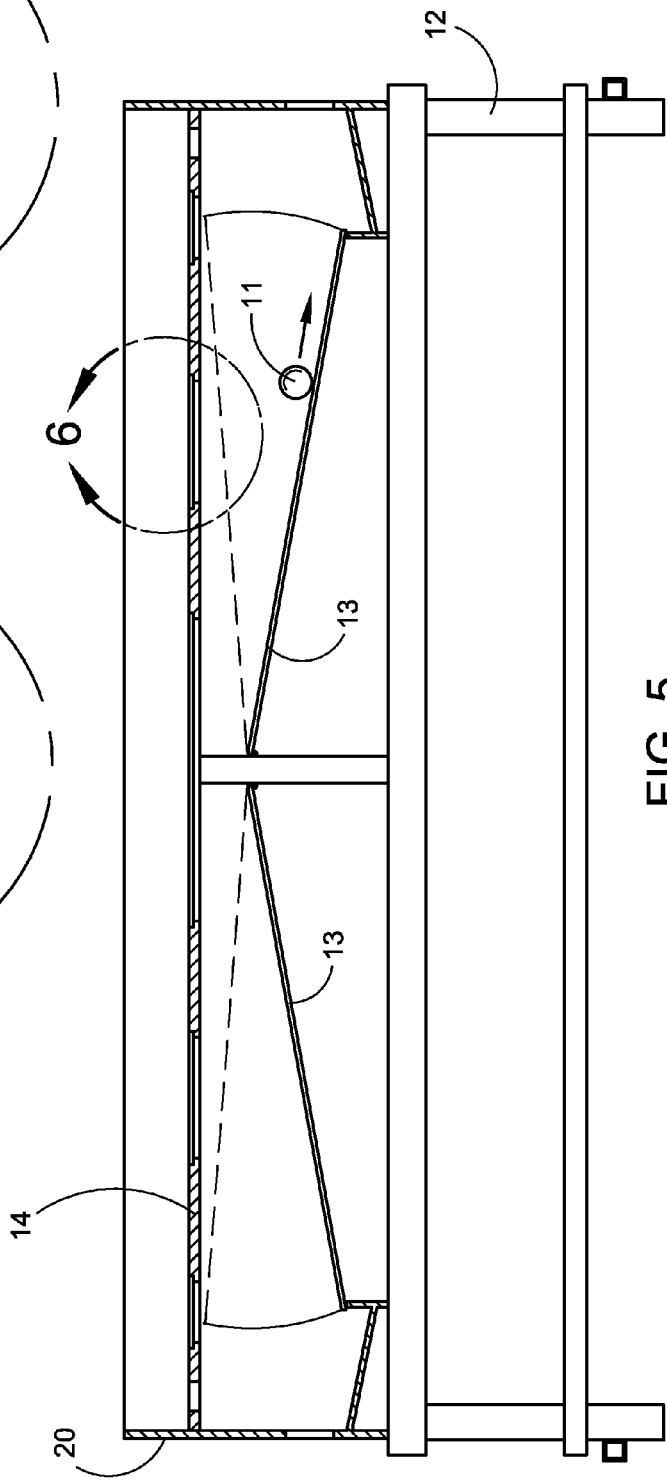
FIG. 5 is a cutaway side view of a table game according to selected embodiments of the current disclosure.

FIG. 5 is a cutaway side view of a table game according to selected embodiments of the current disclosure. This figure shows how the adjustable return panels 13 can be adjusted to send the balls 11 to either side of the table. Beneath the ground game board 14 are two adjustable return panels 13, each of which can be independently raised or lowered to change the direction of ball return. Thus, when a player wants to practice alone, he can tilt the panel on the other side of the board upward, and tilt the panel on his side of the game downward, such that all balls that are hit onto the other side of the game that go into either a goal hole or a trap are returned to the player's side. For a game with two or more players, in a preferred embodiment of the game both panels are tilted downward such that if a ball falls into a goal hole or trap, the ball is returned to the player upon whom the goal was scored or whose trap trapped the ball.

Figure 6B:
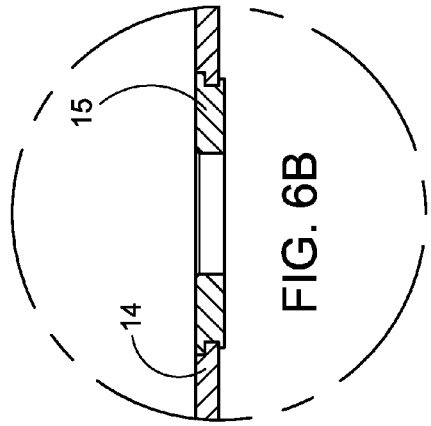
FIG. 6B is a close up side view of a portion with a sliding insert placed therein of a table game according to selected embodiments of the current disclosure.
Figure 6A:
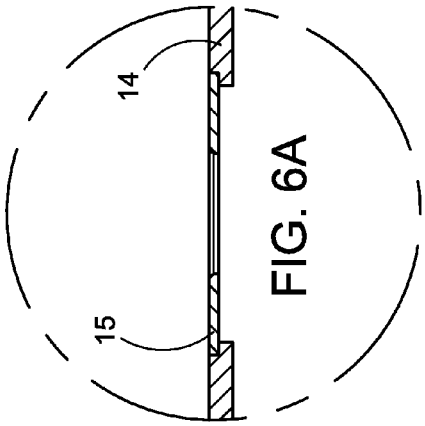
FIG. 6A is a close up side view of a portion with an insert placed therein of a table game according to selected embodiments of the current disclosure.

FIG. 6A is a close up side view of a portion with an insert placed therein of a table game according to selected embodiments of the current disclosure. The insert 15 is supported by lips of the ground game board 14. The use of inserts of different sizes and shapes can be used to alter the complexity and pace of the game, and to handicap games between players of different skill levels.

FIG. 6B is a close up side view of a portion with a sliding insert placed therein of a table game according to selected embodiments of the current disclosure. The insert 15 is supported by the ground game board 14. The insert 15 has edges that extend over both sides of a lip of the ground game board 14, where the insert 15 can slide along the edges but cannot be removed from the ground game board 14.

Figure 7:
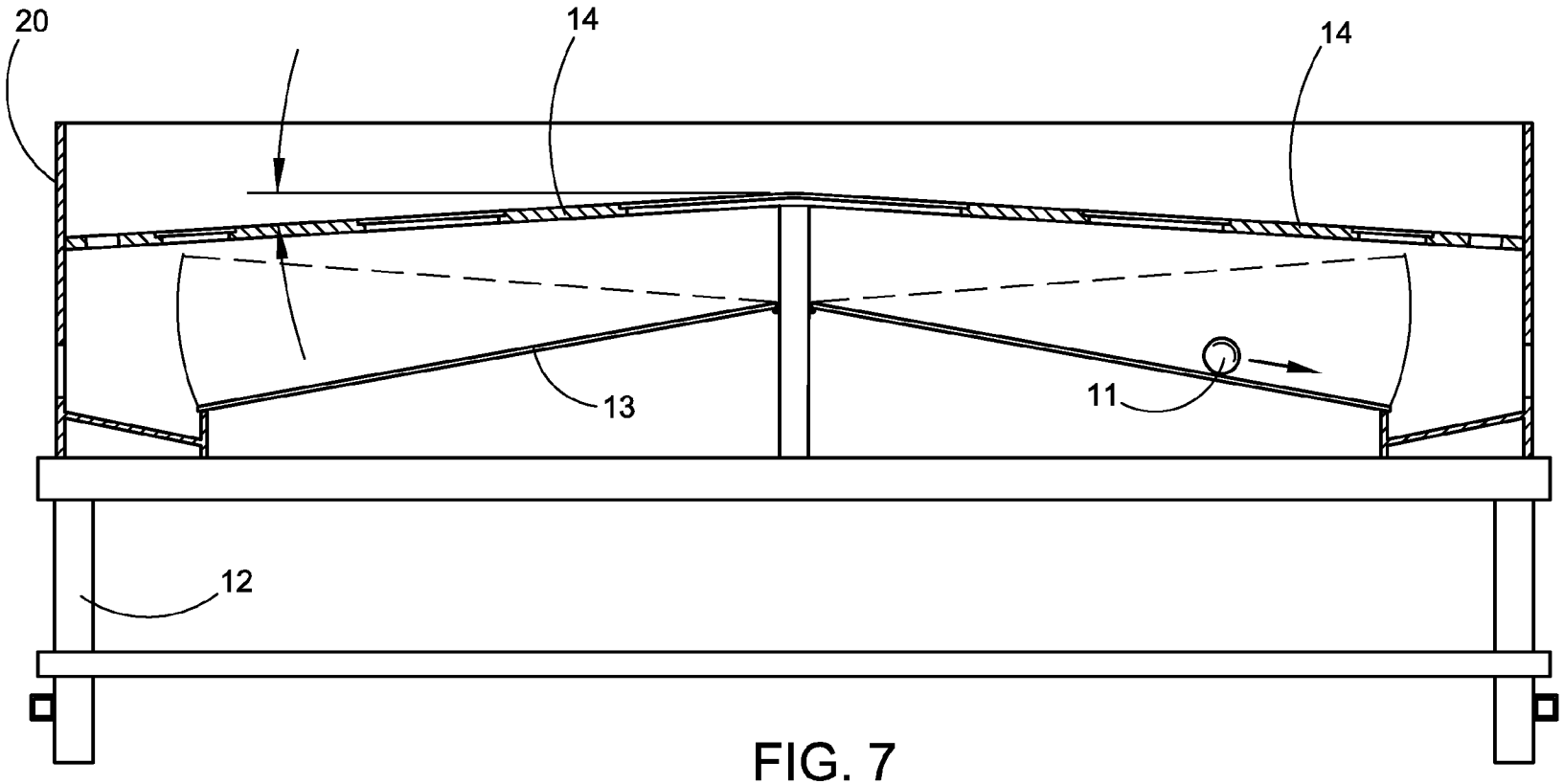
FIG. 7 is a cutaway side view of a table game in an alternative configuration according to selected embodiments of the current disclosure

FIG. 7 is a cutaway side view of a table game in an alternative configuration according to selected embodiments of the current disclosure. To increase the difficulty of the game, each side of the ground game board 14 may be adjustable. By lowering the edges of a side of the ground game board 14, or alternatively raising the center of the ground game board 14, the ground game board 14 becomes angled. Such a configuration requires a player to provide an additional force to a ball to cause it to travel upwards along the inclined ground game board. Alternatively, should that section be inclined in the opposite direction, less force (or even no force) is required to move the ball towards the opponents goal holes. In a particular embodiment, the game is played in a configuration where the ground game board 14 is in a roof top configuration, where each half of the ground game board is inclined towards a player.

In a particular embodiment, the ball is a hard non-elastic ball, a puck similar to a hockey puck, an elastic "bouncy" ball, a beanbag, or a food item, such as an orange, plum, or grapefruit.

Various means of scoring are contemplated whereby players are encouraged to shot a ball through a goal hole and discouraged to have a ball fall through a trap. Inserts, as described above, can also change the scoring of the game. Larger openings in the goal holes may result in fewer points, while larger openings in traps may result in a greater number of points. Thus, individual players may be handicapped by the placement and use of particular inserts and/or scoring mechanisms.

A particular method of practicing the game of the current invention has an offensive player shooting balls into the goal holes of a defensive player while avoiding traps. At the same time, the defensive player uses beanbags in an attempt to block or redirect the shots of the offensive player. The beanbags can be thrown or slid onto various positions on the ground game board in an attempt to block or redirect a shot ball away from a goal hole.

Another method of practicing the game of the current invention is a round robin format, wherein one player plays offensive while the remaining players play defense. The offensive player remains on offense for a set period of time or until other conditions are met, such as three failed attempts at shooting a ball into a goal hole. At that time, the offensive player rotates into a defensive position, and one of the defensive players rotates into the offensive position. The winner of the game is then determined by which player has obtained the greatest number of points.

In yet another method of practicing the game of the current invention, four players, two on each team, compete against each other, but in different realms. One player from each team competes on the ground game, whereby the balls travel on the ground game board, while the other two players compete on the air game, whereby the balls travel through or over the air game board and then bounce onto or through the ground game board. The ground game and air game can be played at separate times or concurrently.

A further method of practicing the game of the current invention has one or more players attempting to get a ball (preferably a beanbag of sorts) into a particular goal hole. Each player takes a turn and records how many attempts it takes to get the ball into the goal hole. The player with the lowest number of attempts wins the game. An alternative embodiment of this idea is similar to the game of "horse" on basketball playgrounds, where players are eliminated from the game should they take the most shots to score. It should be noted that either the "golf" or "horse" version of the game can be practiced by a single person, thereby adding to the desirability of the game.

An additional method of practicing the game of the current invention has players rotate turns until one of the players makes a shot into a goal hole. Then, all subsequent players must make the same shot or is eliminated. These rounds are repeated until a final player is left that has not been eliminated.

In yet another method of practicing the game of the current invention, the players are divided into two teams. Each team plays defense or offense, and switches after a particular condition is met, such as three failed attempts to shoot a ball into a goal hole. While on offense, each player has one chance to shoot a ball into a goal hole. The defense players, at the same time, position inserts or place beanbags in an attempt to block or make it more difficult for the offensive player to successfully shot a ball into a goal hole. The offensive players rotate through each player after each attempt and upon three failed attempts, the offensive players become defensive players and the defensive players become offensive players.

Another embodiment of the game calls for a "baseball" approach where an offensive player tries to score a goal and a defensive player tries to block the shot. If the defensive player stops a certain number of attempts by the offensive player (such as three attempts, as in baseball), the offensive player is "out" and the two players switch offense and defense. This embodiment could be handicapped by forcing the more experienced player to shoot from a further distance away from the table, giving one side larger traps, goal holes, or shooting channels, or selectively applying a mat of material to one side that would slow down the ball, making it easier to defend.

It is also contemplated that while one embodiment of the game calls for a table approximately the size of a Ping-Pong or pool table, it is conceivable that smaller (or even larger) game tables could be produced.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

That which is claimed:

1. A table game comprising a ground game board, an air game board, four adjustable legs, an adjustable return panel, and a ball, where the ground game board comprises a plurality of goal holes and a plurality of traps, where each goal hole and trap comprises an opening, where at least one of the plurality of goal holes further comprises an insert, where the insert of the goal hole comprises a hole that is smaller than the size of the goal hole, whereby the insert of the goal hole may be inserted into the goal hole to decrease the size of the opening of the goal hole thereby making it more difficult to pass the ball through the goal hole, where at least one of the plurality of traps further comprises an insert, where the insert of the trap comprises a hole that is smaller than the size of the trap, whereby the insert of the trap may be inserted into the trap to decrease the size of the opening of the trap thereby making it more difficult to pass the ball through the trap, where the air game board comprises two goal posts, a horizontal cross-bar, and a vertical cross-bar, where the air game board is attached to the ground game board, and where the ground game board is located in a horizontal orientation, where the air game board is located in a vertical orientation, where the ball may be directed through the one or more goal holes or traps, where the return board comprises two flat surfaces, where the two flat surfaces of the return board are joined at a pivot point, where the angle of each of the two flat surfaces of the return board is adjustable such that each flat surface of the return board is parallel to the other or angled, whereby an angled flat surface of the return board causes a ball placed thereon to move towards one side of the table game.

2. A table game comprising a ground game board, a paddle, an air game board, four legs, an adjustable return panel, and a ball, where the ground game board comprises a plurality of goal holes and a plurality of traps, where each goal hole and trap comprises an opening, where the air game board comprises two goal posts and a horizontal cross bar, where the air game board is attached to the ground game board, and where the ground game board is located in a horizontal orientation, where the air game board is located in a vertical orientation, where the ball may be directed through the one or more goal holes or traps, where the return board comprises two flat surfaces, where the two flat surfaces of the return board are joined at a pivot point, where the angle of each of the two flat surfaces of the return board is adjustable such that each flat surface of the return board is parallel to the other or angled, whereby an angled flat surface of the return board causes a ball placed thereon to move towards one side of the table game, and where the paddle comprises a handle portion and may be used to strike the ball.

3. The table game of claim 2, further comprising a paddle, wherein the paddle may be used to strike the ball.

4. The table game of claim 2, wherein the four legs are adjustable in height.

5. The table game of claim 2, wherein at least one of the plurality of goal holes further comprises an insert, where the insert comprises a hole that is smaller than the size of the goal hole, whereby the insert may be inserted into the goal hole to decrease the size of the opening of the goal hole thereby making it more difficult to pass the ball through the goal hole.

6. The table game of claim 2, wherein the ball is selected from the group consisting of bouncing balls, non-elastic balls, pucks, and beanbags.

7. The table game of claim 2, wherein the paddle comprises a handle portion.

8. The table game of claim 2, wherein both flat surfaces of the return board are at the same angle, whereby a ball placed on either flat surfaces moves towards the same side of the table game.

9. The table game of claim 2, further comprising a second ball, wherein the ball and the second ball may each move simultaneously on or over the ground game board.

10. The table game of claim 2, wherein the air game board further comprises a vertical cross-bar.

11. The table game of claim 2, wherein the air game board further comprises a plurality of vertical cross-bars.

12. The table game of claim 2, wherein at least one of the plurality of traps further comprises an insert, where the insert comprises a hole that is smaller than the size of the trap, whereby the insert may be inserted into the trap to decrease the size of the opening of the trap thereby making it more difficult to pass the ball through the trap.

13. A method of playing a table game comprising the steps of obtaining a game table, where the game table comprises a ground game board, an air game board, four legs, an adjustable return panel, and a ball, where the ground game board comprises a plurality of goal holes and a plurality of traps, where each goal hole and trap comprises an opening, where the air game board comprises two goal posts and a horizontal cross bar, where the air game board is attached to the ground game board, and where the ground game board is located in a horizontal orientation, where the air game board is located in a vertical orientation, where the ball may be directed through the one or more goal holes or traps, where the return board comprises two flat surfaces, where the two flat surfaces of the return board are joined at a pivot point, where the angle of each of the two flat surfaces of the return board is adjustable such that each flat surface of the return board is parallel to the other or angled, whereby an angled flat surface of the return board causes a ball placed thereon to move towards one side of the table game, and shooting the ball into one of the plurality of goal holes.

14. The method of claim 13, further comprising the step of adjusting the adjustable return panel such that when the ball falls into any of the goal holes or traps, it is returned to one side of the table game, whereby a single player may play the table game.

15. The method of claim 13, wherein the table game is played by two players who takes turns playing an offensive role and a defensive role, and where when a player is playing an offensive role, the player is known as an offensive player, and where when a player is playing a defensive role, the player is known as a defensive player, and where the offensive player plays from an end portion of the game table and the defensive player plays from a side portion of the game table.

16. The method of claim 13, wherein the game table comprises a second ball.

17. The method of claim 16, further comprising the steps of a second player shooting the second ball at the same time that the first ball is shot, whereby two players play on the same game table simultaneously.

18. The method of claim 13, wherein the table game is played by four players, and the four players are divided up into two teams, where each team has one player playing an offensive role and one player playing a defensive role, where an offensive role attempts to shoot the ball into a goal hole, where a defense role attempts to prevent the team playing the offensive role from shooting the ball into a goal hole.

19. The method of claim 18, further comprising the steps of switching the roles of the two teams, whereby the team that was in the offensive role assumes the defensive role, where the team that was in the defensive role assumes the offensive role.

20. The method of claim 13, wherein the table game is played by eight players, where the eight players are divided up into two teams of four players, where each team of four players includes two offensive players and two defensive players.

* * * * *